United States Patent [19]

Harris

[11] Patent Number: 4,962,599

[45] Date of Patent: Oct. 16, 1990

[54] QUICK CONNECT-DISCONNECT COUPLING FOR SNOW PLOW

[75] Inventor: Gary S. Harris, Sabattus, Me.

[73] Assignee: DSP, Inc., Auburn, Me.

[21] Appl. No.: 507,917

[22] Filed: Apr. 12, 1990

[51] Int. Cl.[5] ..... E01H 5/04; E01H 5/06

[52] U.S. Cl. ..... 37/266; 37/235; 37/234; 37/231

[58] Field of Search ..... 37/231, 234, 236, 235, 37/266

[56] References Cited

U.S. PATENT DOCUMENTS

| | | | |
|---|---|---|---|
| 3,410,008 | 11/1968 | Standfuss . | |
| 3,456,369 | 7/1969 | Leposky . | |
| 3,512,804 | 5/1970 | Siegert | 37/231 X |
| 3,851,894 | 12/1974 | St. Pierre | 37/231 X |
| 3,987,562 | 10/1976 | Deen et al. | 37/231 |
| 4,236,329 | 12/1980 | Hetrick | 37/231 |
| 4,462,172 | 7/1984 | Caron | 37/231 |
| 4,744,159 | 5/1988 | Houle | 37/231 |
| 4,769,933 | 9/1988 | Dejana | 37/231 |

*Primary Examiner*—Dennis L. Taylor
*Assistant Examiner*—J. Russell McBee
*Attorney, Agent, or Firm*—Body, Vickers & Daniels

[57] ABSTRACT

A quick connect-disconnect coupling is provided for snow plows and like devices. The coupling includes a hitch ear plate and a retaining ear plate preferably attached to the plow. The hitch ear plate has a configured gathering surface and the retaining ear plate has a hitch pin opening extending therethrough. A bracket arrangement preferably attached to the vehicle contains a spring biased axially movable hitch pin. The hitch ear plate positions the retaining plate so that its opening is in registry with the hitch pin when the plow is to be coupled to the vehicle. Rotation of the hitch pin allows the spring to axially move the hitch pin and snap the pin through the hitch pin opening to lock the plow to the vehicle.

12 Claims, 7 Drawing Sheets

QUICK CONNECT-DISCONNECT COUPLING FOR SNOW PLOW

This invention is generally applicable to snow plows and the like and more particularly to a quick connect-disconnect coupling for mounting a snow plow blade to a vehicle.

The invention is particularly applicable to and will be described with particular reference to an arrangement for attaching a standard type, general service snow plow to commercial vehicles such as pick-up trucks, 4×4's, etc., used to clear snow from parking lots, driveways and the like. However, the invention has broader application and could be applied on the one hand to heavy duty snow plows such as are mounted on salt-applying dump trucks used in clearing snow from highways and on the other hand could be used for mounting snow plows and like garden attachments to relatively small garden tractors and like devices.

INCORPORATION BY REFERENCE

The following patents are incorporated hereby by reference:

(a) U.S. Pat. No. 3,410,008 to Standfuss;
(b) U.S. Pat. No. 3,456,369 to Leposky; and
(c) U.S. Pat. No. 3,987,562 to Deen et al.

BACKGROUND

The snow plow arrangement to which this invention refers fundamentally comprises a moldboard plow blade pivotally mounted to a pushframe which in turn is attached to a pushbeam mounted to the frame of the vehicle. Functionally, the pushframe is a V-shaped weldment with the moldboard frame pivotally mounted to the apex of the V and the base of the V-shaped legs pivotally secured to the pushbeam so as to permit movement of the pushframe only in a vertical direction. A cylinder, typically hydraulic, attached to the vehicle either by the pushbeam or through a separate mount and also attached typically by a chain to the pushframe raises and lowers the plow by causing the pushframe to pivot at the base of its V-shaped legs about the pushbeam. Cylinders, typically hydraulic, at each side of the V-shaped legs with one end fixed at the leg and the other end fixed to the moldboard frame provide for tilting or yaw of the board to permit the snow to be directed to one side or the other side of the plow during snow removal operation.

From a plow operation point of view, a preferred mount arrangement would be to form the base of the V-shape legs or struts on the pushframe as a box channel through which hitch pin openings are drilled in each sidewall of the channel. The channel would then be positioned between two brackets welded onto the pushframe and having openings so that the hinge pin would extend through and be journaled in the bracket and channel openings. Each strut would then have two bearing surfaces, one at each channel sidewall, which would pivot about the hinge pin which in turn is securely journaled in the two brackets which sandwich the strut end. This type of connection is preferred because it is a tight connection in the sense that there is no forward to rearward lost motion which could result in excessive wear on the connection. Also, there is no side to side lost motion while at the same time pivoting motion of the pushframe is permitted. While this type of connection is preferred in the sense of plow operation, the connection makes it difficult to attach the pushframe to the vehicle. The plow with pushframe has to be properly oriented, manually, to the vehicle and a drift or other similar implement used to bring the holes into registry. Even after the hinge pin clears or passes through the first opening in the channel sidewall, it may not easily pass through the second opening in the opposite channel sidewall. The same problems are present on removal. Thus, snow plow operators do not remove the blades during the snow plowing season even though there are many times during the season where it would be desirable to disconnect the moldboard for non-plowing vehicle use.

The prior art has recognized this problem and a number of quick connect-disconnect couplings have been proposed. The three patents cited above and incorporated herein by reference are believed typical of the various approaches. In the '369 patent, an open ended U-shaped slot in an aligning plate is used to guide the pushframe over a fixed pin and when the pin contacts the end of the slot, a latch having a similar open ended U-shaped slot is pivoted over the pin so that the pin is locked between the two U-shaped slots which are at right angles to one another. A similar arrangement is shown in the '008 patent in that the U-shaped slot in the aligning plate of the '369 patent is replaced by a V-shaped slot in the '008 patent to improve the gathering range of the connection. When the pin is positioned at the base of the V-shaped slot of the aligning plate in the '008 patent, a similar open ended latch is pivoted over the hinge pin so that the pin is held between the latch and the aligning plate as done in the '369 patent. In the '008 patent, the opening in the V-shaped aligning plate is at right angles to the opening in the latch and is identified in function to the arrangement disclosed in the '369 patent. A similar arrangement is also disclosed in the '562 patent which uses a bell crank arrangement positioned on the pushframe to pivot a J-shaped hook into locking engagement with the hinge pin after the aligning plate on the coupling has positioned the frame into proper relationship with the pin. While all three patents have a quick connect-disconnect coupling, the pin connection function they provide is poor. In essence, the pin is captured or journaled between two plates which must have openings extending at least 180°. This means the pin is not journaled about its entire circumference resulting in a connection which inherently has to have more looseness or slop, at least when compared to the prior art pin connection which did not have quick connect features. In addition, each of the patents discussed journal the hinge pin at only one point per strut. This arrangement is thus less stable and more susceptible to wear than the prior art arrangement discussed above which did not have quick disconnect-connect features. Finally, all arrangements use permanently mounted or fixed hitch pins or hitch rods which makes their replacement difficult and/or expensive.

BRIEF SUMMARY OF THE INVENTION

Accordingly, it is a principal object of the present invention to provide a coupling which can quickly connect and disconnect a snow plow from a vehicle but which when connected, provides a tight pin connection in contrast to the prior art arrangements discussed above.

This object along with other features of the invention is achieved in a quick connect-disconnect coupling for mounting a pushframe attached to a plow to a pushbeam attached to a vehicle. The pushframe has a forward end mounted to the moldboard frame of the plow and a rearward end which has a pair of laterally spaced positioning ear mechanisms for coupling and uncoupling the frame to the pushbeam. Each of the ear positioning mechanisms includes a hitch ear plate and laterally spaced therefrom a retaining ear plate. The hitch ear plate has a forward end affixed to the pushframe and a rearward end which has a rearward edge surface defined by a gathering surface terminating in a generally centrally positioned, semi-circular, pin locating surface. The retaining plate has a forward end affixed to the pushframe and a rearward end with a generally circular hitch pin opening extending therethrough. The ear plates are attached to the pushframe so that the semi-circular locating surface of the hitch ear plate is aligned with the hitch pin opening of the retaining ear plate. The pushbeam has a pair of laterally spaced pin mechanisms for being coupled to and uncoupled from the positioning ear mechanisms. Each pin mechanism includes an inboard mounting bracket, an outboard mounting bracket and an intermediate bracket therebetween. Each bracket has a generally circular opening extending therethrough with all bracket openings aligned with one another. A hitch pin and a two position spring mechanism associated with the hitch pins is provided. The spring mechanism operates to position the hitch pin from an uncoupled position whereat the pin is journaled only in the inboard and intermediate brackets with one of its ends generally flush with the intermediate bracket to a coupled position whereat the hitch pin extends through and is journaled in all of the openings in all of the brackets. The ear positioning mechanism and the pin mechanism thus cooperate with one another to accurately position the retaining plate between the outboard and the intermediate brackets and when the semi-circular pin locating surface contacts the hinge pin on the side of the inboard bracket which is opposite to that side facing the intermediate bracket when the spring mechanism is in its uncoupled position. When the spring mechanism is then actuated to its coupled position, the hitch pin extends through the circular opening of the retaining air plate so that the pushframe is connected in a true pin connection to the pushbeam.

In accordance with another feature of the invention, the spring mechanism includes a compression spring receiving the hitch pin and positioned between the intermediate bracket and the inboard bracket. A snap type ring is affixed to the hitch pin at a position on the hitch pin such that the spring is compressed between the snap ring and the inboard bracket. A handle is secured to the end of the hitch pin which is adjacent the inboard bracket for compressing and latching the spring when the spring mechanism is in its uncoupled position. Moving the handle unlatches the spring and permits the spring to expand and axially move the hitch pin through the opening in the retaining ear plate and also the opening in the outboard bracket to automatically couple the pushframe to the pushbeam with an operating "ease of hook up" not found in other prior art quick connect couplings.

In accordance with another aspect of the invention, the hitch ear retainer plate has a plurality of hitch pin openings extending therethrough. The rearward end of the pushframe includes a strut having more than two fastener openings. The forward end of the hitch ear plate has more than two openings and fasteners or connecting means are provided for securing the forward end of the hitch ear plate to the strut through at least two openings in the strut and the ear plate which are aligned with one another. The fastening openings in the ear plate and in the strut are in a predetermined relationship with one another so that by only positioning the ear plate relative to the strut to use two different fastening openings results in the alignment of the ear plate with a different hitch pin opening in the retainer plate so that compensation for different vehicle heights can be easily accommodated in the coupling.

In accordance with still another aspect of the invention, the intermediate bracket has a rearward end affixed to the pushbeam and a forward end such that the circular pin opening in the intermediate bracket is spaced in between its forward and rearward ends. The intermediate bracket is bent between its forward end and a position adjacent to its pin opening in a direction toward the inboard bracket to provide a positioning surface which in conjunction with the gathering surface on the hitch ear plate directs the retainer ear into the space between the intermediate and the outboard brackets while permitting the gathering surface of the hitch ear to contact the hitch pin adjacent to the inboard bracket. Similarly, the intermediate bracket has a bottom tab bent towards the inboard bracket to assure ear plate positioning when the ear plates are brought into registry with the pin mechanism from underneath the pushbeam. In this way, the gathering range of the connector is increased while positive positioning of the pushframe relative to the pushbeam is assured to permit trouble free actuation of the spring mechanism from its uncoupled to its coupled position.

In accordance with yet another feature of the invention, the hitch ear plate and the retaining ear plate could be applied to the pushbeam and the inboard, outboard and intermediate brackets applied to the pushframe.

Yet in accordance with another aspect of the invention, the plates, the brackets and the hitch pins can be supplied as loose pieces in kit form for retrofit application to existing snow plow applications.

It is thus a principal object of the present invention to provide a quick connect-disconnect coupling for snow plow applications and the like which uses a true pin connection to maintain the integrity and long term service life of the plow.

It is another principal object of the invention to provide a quick connect-disconnect coupling for snow plow applications which permits trouble-free, easy mounting and dismounting of the plow to the vehicle.

It is another object of the invention to provide a quick connect-disconnect coupling for snow plows and the like which has improved gathering or positioning features to assure a fast and easy hookup.

Still yet another object of the invention is provide a quick connect-disconnect coupling arrangement for use in a snow plow and the like which can easily be adjusted to compensate for the variations in vehicle height.

Still yet another specific object of the invention is to provide a quick connect-disconnect coupling arrangement for use in a snow plow which uses for each pushframe strut two laterally spaced pin bearing surfaces to achieve a stable pushframe-pushbeam connection.

Still yet another object of the invention is to provide a coupling arrangement for use with a snow plow or like implement which can be supplied in kit form for universal plow applications.

Still yet another feature of the invention is to provide a quick, disconnect coupling arrangement which, compared to prior art couplings, is simple and inexpensive and/or which, when worn, uses components which can be easily replaced.

Still further advantages of the invention will become apparent to those of ordinary skill in the art upon a reading and understanding of the following description of the preferred embodiment of the invention.

BRIEF DESCRIPTION OF THE DRAWINGS

The invention may take form in certain parts and arrangement of parts, a preferred embodiment of which will be described in detail herein and illustrated in the accompanying drawings which form a part hereof and wherein.

DETAILED DESCRIPTION OF THE PREFERRED EMBODIMENT

Figure 1:
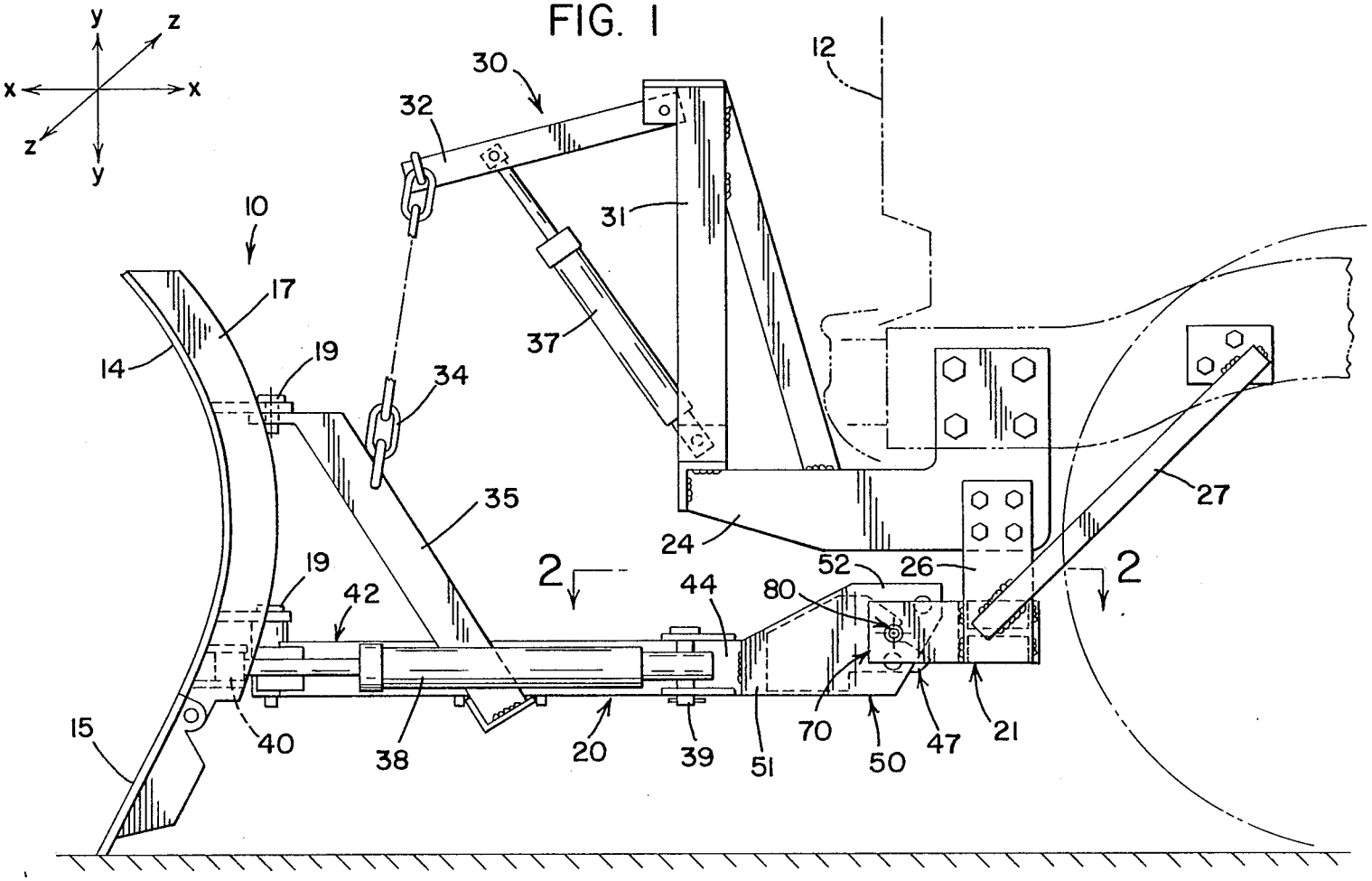
FIG. 1 is a side elevation view of a snow plow.

Referring now to the drawings wherein the showings are for the purpose of illustrating a preferred embodiment of the invention only and not for the purpose of limiting the same, there is shown in FIG. 1 a snow plow arrangement 10 mounted to a vehicle 12 which is shown in dot-dash lines in FIG. 1. Snow plow arrangement 10 includes a conventional moldboard 14 and a plow blade 15 mounted to a plow frame 17. Plow frame 17 is pivotally connected as at 19 to a pushframe 20.

Pushframe 20 is adapted to be mounted to a pushbeam 21 which in turn is fixed to vehicle 12. Any conventional mounting arrangement can be used to fix pushbeam 21 to vehicle 12. The mounting arrangement illustrated in FIG. 1 is intended to be typical. The support arrangement shown includes a lift support bracket 24 affixed as by fasteners to the ladder frame or subframe of vehicle 12 shown in dot-dash lines in FIG. 1. Affixed to lift support bracket 24 as by fasteners is a pushbeam support bracket 26 which secures pushbeam 21 to the vehicle's frame vis-a-vis pushbeam support bracket 26 and lift support bracket 24. Rigidizing pushbeam 21 is pushbeam support strut 27 which, as shown, is welded at one end to pushbeam 21 and bolted at its other end to the frame of vehicle 12.

Lift support bracket 24 functions to fix lift assembly 30 to the vehicle's frame and lift assembly 30 functions to raise or lower snow plow 10. Lift assembly 30 as shown is conventional and includes a stationary support member 31 affixed to lift support bracket 24 and from which lift arm 32 is pivotally connected at one of its ends. At the opposite end of lift arm 32 is a chain 34 which in turn is attached to a lift strut 35 which is part of pushframe 20. A lift cylinder 37, typically hydraulic, is pinned at one end to lift arm 32 and at its other end to stationary support member 31. Lift cylinder 37 operates to raise or lower lift arm 32 and in turn raise or lower snow plow 10 in a conventional manner. For reference purposes in discussing the operation of the quick connect-disconnect coupling of the present invention, a three dimensional x-y-z plane is shown in FIG. 1. It is to be noted that lift cylinder 37 is raising or lowering snow plow 10 in the x-y plane only. Thus, the quick connect-disconnect coupling must permit pushframe 20 to pivot in the x-y plane. Movement of moldboard 14 and plow blade 15 in the x-z plane is achieved by means of a pair of plow blade cylinders 38, only one of which is shown. As shown in FIG. 1, each plow blade cylinder 38 is pinned at one end 39 to pushframe 20 and at its opposite end 40 to plow frame 17. Actuation of cylinders 38 control the angle skew or yaw of moldboard 14 relative to the ground so that the snow can be pushed to one side of snow plow 10 in a conventional manner. A typical snow plow 10 with a typical mounting arrangement has been described and to this point in the description, the entire arrangement is conventional.

Figure 2:
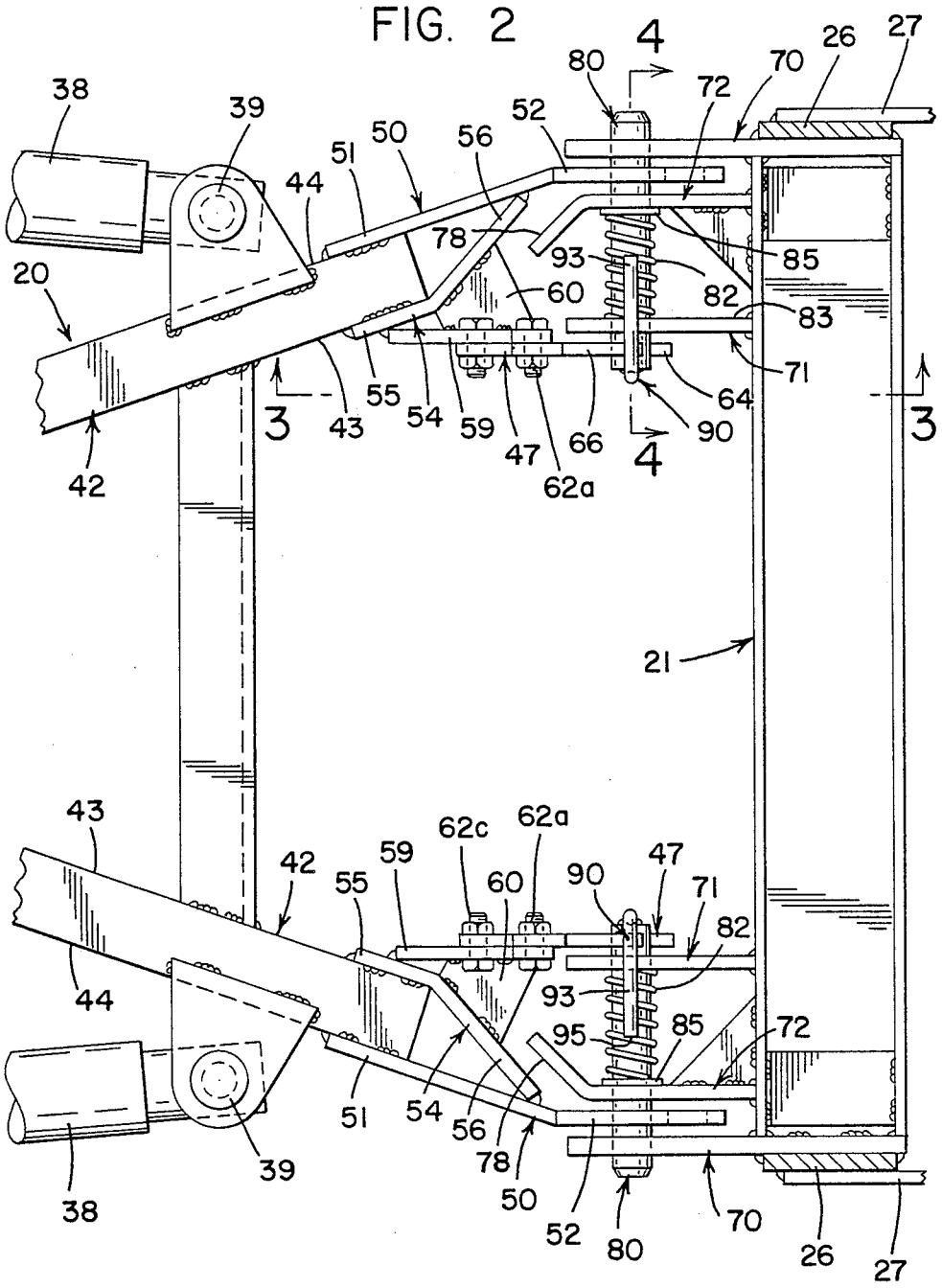
FIG. 2 is a top plan view of a portion of the snow plow shown in FIG. 1 illustrating the coupling of the present invention in a coupled position taken along line 2—2 of FIG. 1.
Figure 3:
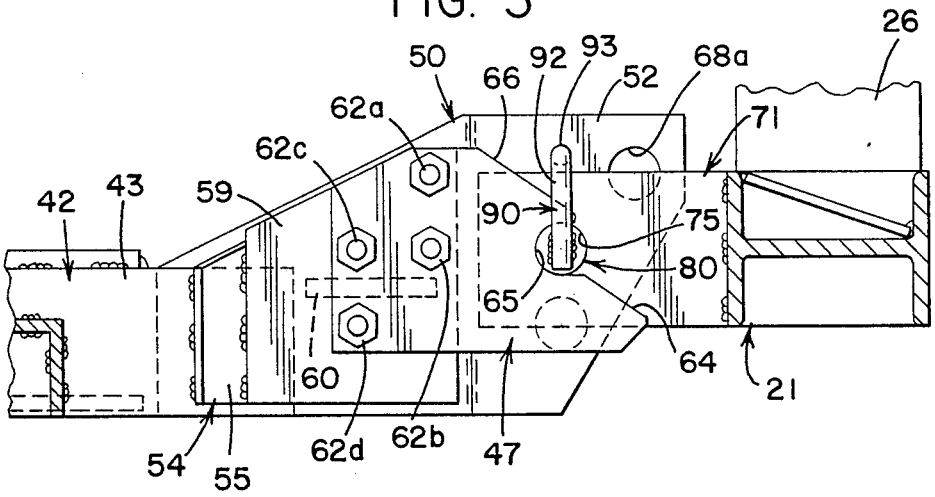
FIG. 3 is a side elevation view of the coupling mechanism taken along line 3—3 of FIG. 2.

As discussed generally above, pushframe 20 is generally a V-shaped weldment having a forward end which is the apex of the V pinned as at 19 to plow frame 17 and a rearward end which is shown in top plan view in FIG. 2. The legs of the V-shaped pushframe 20 or struts 42 are formed as a box channel or box shaped construction and have an inboard wall 43 and an outboard wall 44 laterally spaced therefrom. Ear positioning means are affixed to the rear end of each strut 42 and since there are two struts, the ear positioning means will be described only with reference to one strut 42, it being understood that an identical arrangement is used on the other strut 42.

Ear positioning means includes a hitch ear plate 47 affixed to inboard wall 43 of strut 42 and a retaining ear plate 50 affixed to outboard wall 44 of strut 42. A weldment is used to securely fix ear plates 47, 50 to strut 42 in parallel, laterally spaced and aligned relationship with one another. As shown in FIGS. 2 through 8, retaining ear plate 50 has mounting wall portion 51 which is parallel to and welded to outboard wall 44 of strut 42 and a retaining ear portion 52 which is bent relative to mounting wall portion 51 so as to be perpendicular to pushbeam 21. Retaining ear plate 52 is rigidized by a support plate 54. Support plate 54 has an inboard mount wall portion 55 which is welded to inboard wall 43 of strut 42 and a brace portion 56 bent from inboard mount wall portion 55 and welded to mounting wall portion 51 of retaining ear plate 50. A hitch tab 59 is welded to inboard mount wall portion 55 of support plate 54 and to a gusset 60 which in turn is welded to brace portion 56 of support plate 54. Alternatively, hitch tab 59 and gusset 60 could be formed as a unitary structure. When affixed to support plate 54 hitch tab 59 is parallel with retaining ear portion 52 of retaining ear plate 50. Hitch tab 59 has a plurality of mounting openings and hitch ear plate 47 also has a plurality of mounting openings for receiving fasteners 62 whereby hitch ear plate 47 can be secured to hitch tab 59. The mounting openings are in predetermined relationship with one another and in the preferred embodiment shown there are four fasteners extending through the four mounting openings which will be designated as 62*a*, 62*b*, 62*c* and 62*d*. Although four fasteners are shown in the preferred embodiment, it is to be clear that only two fasteners 62 are required to secure hitch ear plate 47 to hitch tab 59. It also should be clear that the weldment described for mounting hitch ear plate 47 and retaining ear plate 50 to the rear end of struts 42 fixes a laterally spaced and parallel relationship between hitch ear plate 47 and retaining ear plate 50. The weldment illustrated is preferred because it is rigid, simple and provides for adjustments which will be described hereafter. However, other weldments and even fastener arrangements could conceivably be used to mount hitch ear plate 47 and retaining ear plate 50 to struts 42 in a laterally spaced and aligned relationship.

Figure 6:
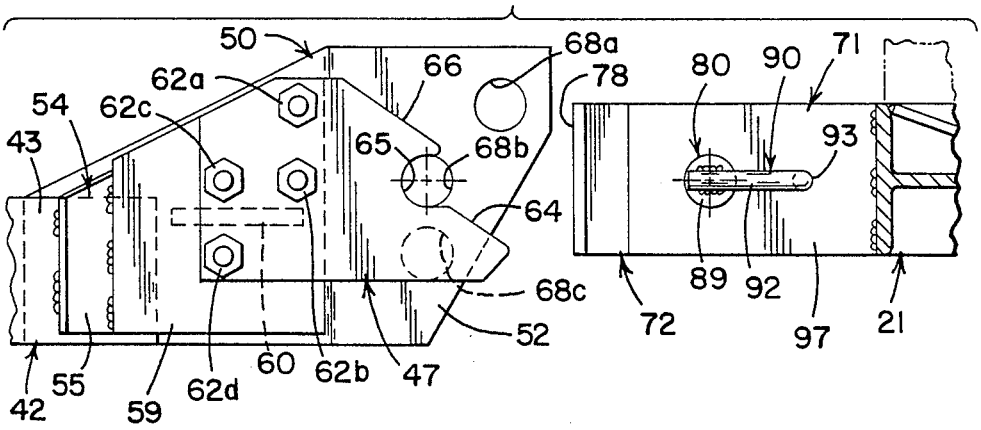
FIG. 6 is a side elevation view of the coupling mechanism of the present invention shown in FIG. 5.
Figure 7:
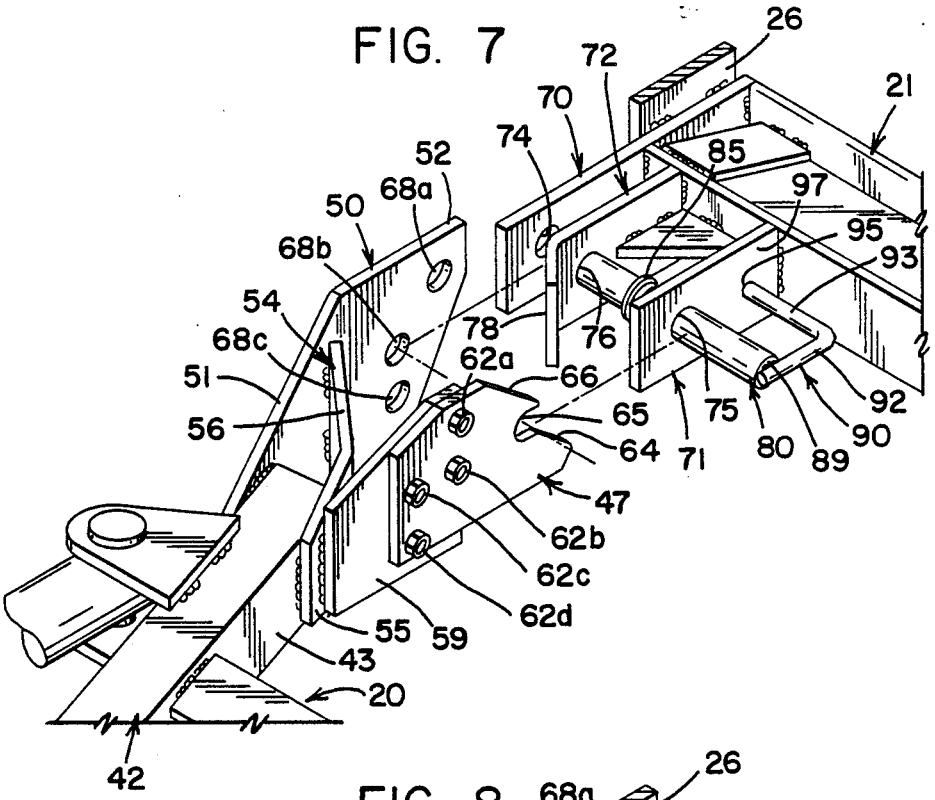
FIG. 7 is a perspective view of the coupling mechanism of the present invention shown in its unapplied, unactuated position.
Figure 8:
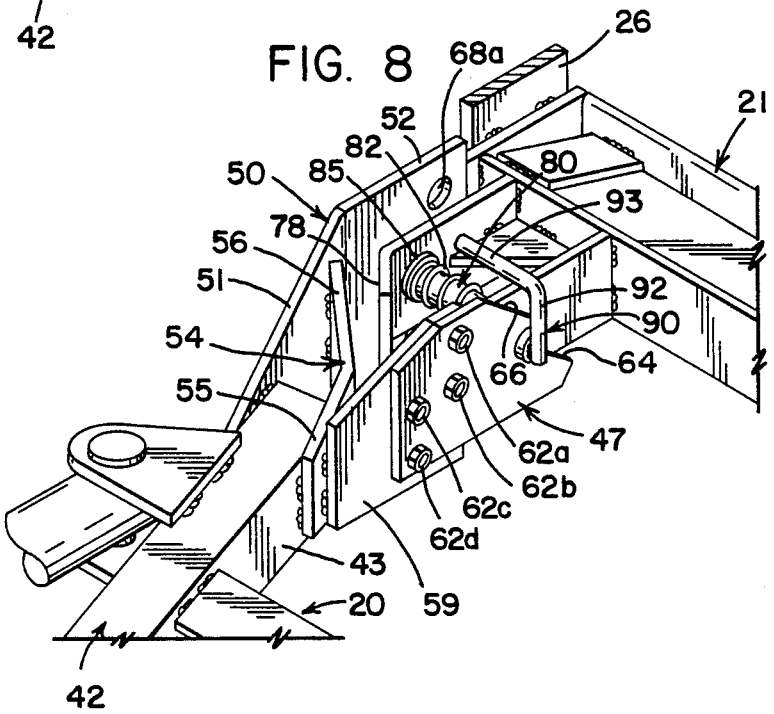
FIG. 8 is a perspective view of the coupling mechanism similar to that shown in FIG. 7 and showing the mechanism in its applied and actuated position.
Figure 9:
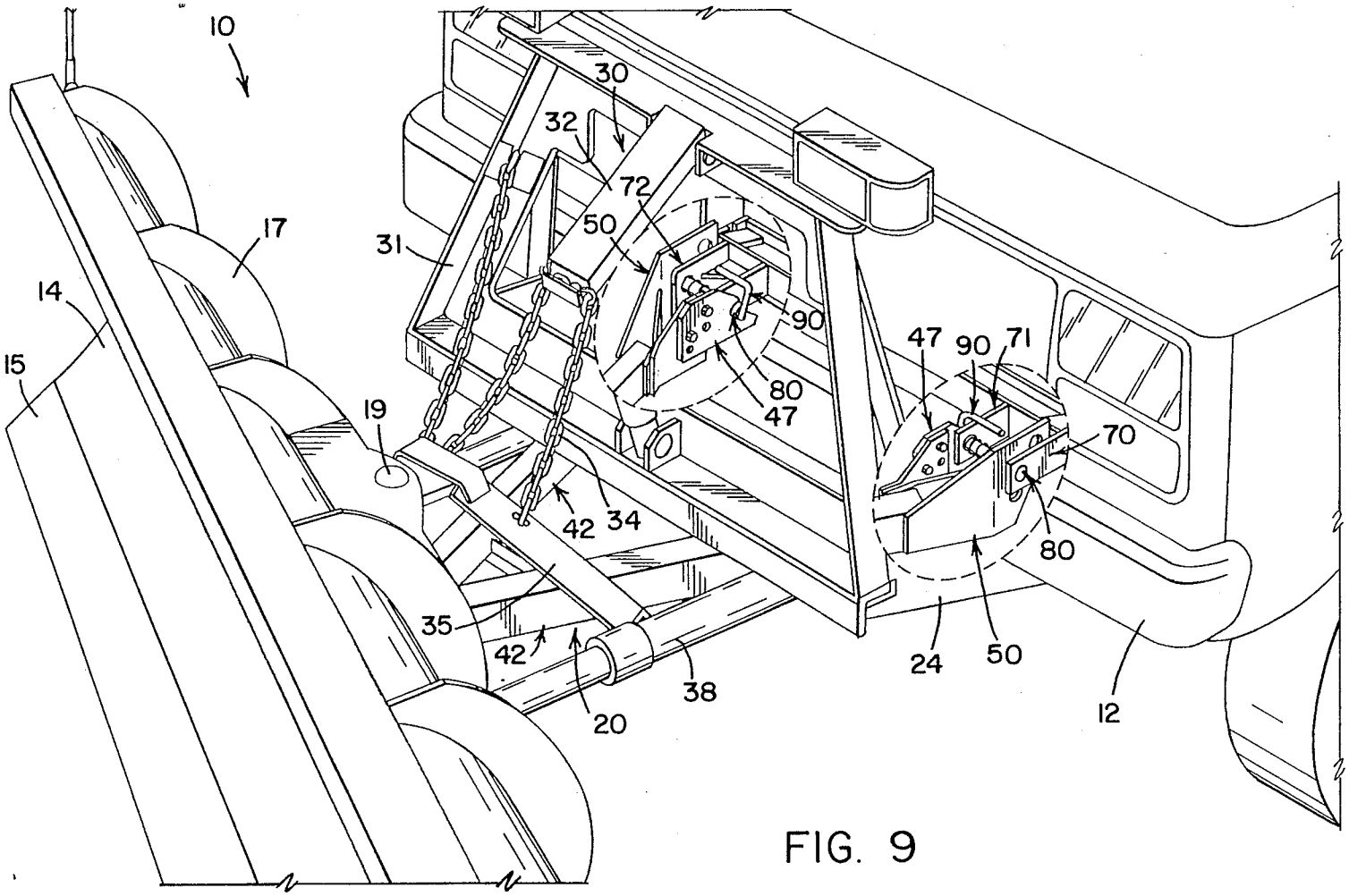
FIG. 9 is a perspective view of a snow plow installed on a vehicle with circular inserts illustrating perspective views of the coupling mechanism of the present invention.

Referring now to FIGS. 3, 6, 7 and 8, the rearward end or rearward edge of hitch ear plate 47 is defined by a gathering surface 64 sloping from the outermost rearward point of hitch ear plate 47 and from the lowermost portion of hitch ear plate 47 to a centrally located or positioned, semi-circular, pin locating surface 65. Semi-circular pin locating surface 65 at its diametrically opposite end is then contiguous with a sloping relief surface 66 which is shown in the drawings to be generally parallel with gathering surface 64. An alternative arrangement would be to form relief surface 66 as a gathering surface extending rearwardly instead of forwardly at an approximate angle of about 45° to pin locating surface 65 to define a rearward edge which would then be generally V-shaped terminating at semi-circular pin locating surface 65. However, because pushframe 20 is generally higher than pushbeam 21 in a typical connect situation, there is no reason to provide a gathering surface to cover the instance where pushframe 20 is lower than pushbeam 21 and thus the reason for relief surface 66. In retaining ear portion 52 of retaining ear plate 50 is at least one hitch pin opening 68 extending therethrough and in the preferred embodiment there are three hitch pin openings designated 68*a*, 68*b* and 68*c*. As best shown in FIG. 6, when hitch ear plate 47 is fastened to hitch tab 59 such that all four fasteners 62*a–d* are used, semi-circular pin locating surface 65 is aligned with and in registry with hitch pin opening 68*b*. The diameter of semi-circular pin locating surface 65 is of course identical or generally equal to the diameter in hitch pin opening 68. Because snow plow 10 is a standard unit sold for application to various vehicles, a height adjustment has to be provided. This is accomplished by selective use of hitch pin openings achieved by varying the mounting position of hitch ear plate 47. If hitch pin opening 68*a* was to be used, fasteners 62*c* and 62*d* would be used in the openings in hitch ear plate 47 and hitch tab 59 through which fasteners 62*a* and 62*b* extend as shown in FIG. 6. If hitch pin opening 68*c* were to be used, then fastener 62*a* would be used in the openings currently occupied by fastener 62*b* and fastener 62*c* would be inserted in the openings currently occupied by fastener 62*d* to bring semi-circular pin locating surface 65 into registry with hitch pin opening 68*c*. Other bolt hole arrangements can be used.

Pin means are provided for each positioning means, and only one of the pin means will be discussed, it being understood that two such pin means are provided for in the preferred embodiment. Pin means include an outboard bracket 70, an inboard bracket 71 and an intermediate bracket 72 therebetween, each of which is welded to the forward face of pushbeam 21. Brackets 70–72 are laterally spaced from one another precise distances for reasons which will be shortly apparent and are parallel to one another and also generally parallel to hitch ear plate 47 and retaining ear plate 50. A circular opening 74 is provided in outboard bracket 70. A similar circular opening 75 extends through inboard bracket 71 and an identical circular opening 76 also extends through intermediate bracket 72. All circular openings 74–76 are identical to one another and aligned with and in registry with one another. All brackets 70–72 are identical and have a predetermined distance from their rearward end to openings 74–76 which are identical. However, intermediate bracket 72 is shaped to have a longer distance extending from its forward end to its circular opening 76 which is bent into an aligning surface 78 in the direction of inboard bracket 71.

Figure 4:
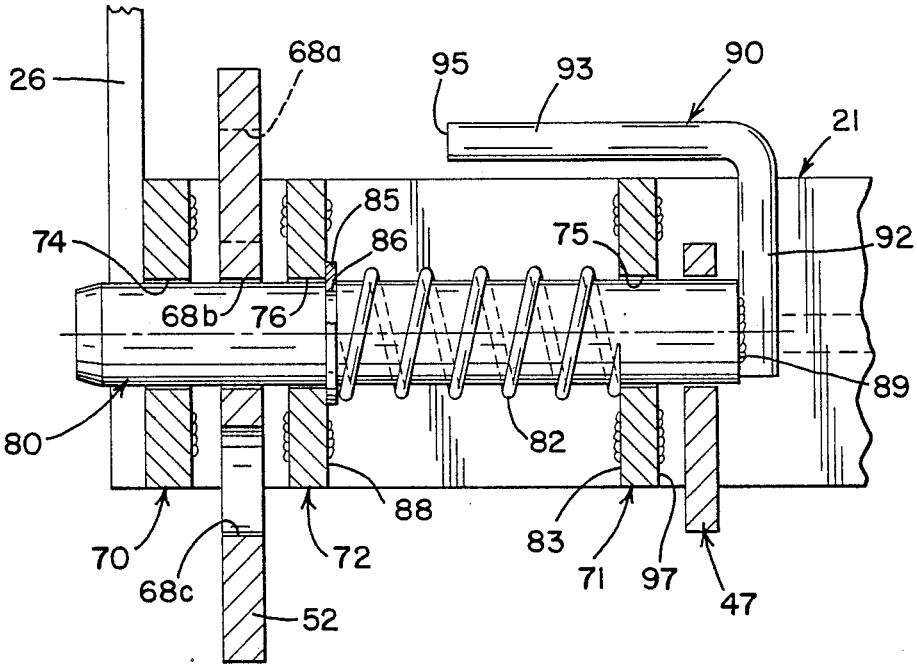
FIG. 4 is an elevation view of the coupling mechanism of the present invention taken along line 4—4 of FIG. 2.
Figure 5:
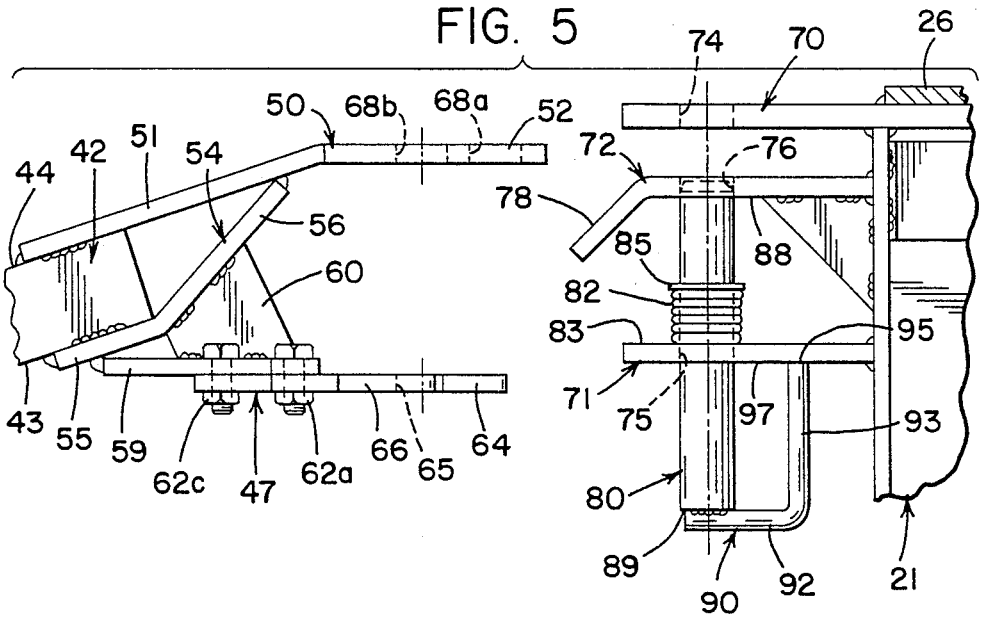
FIG. 5 is a top plan view of the coupling mechanism of the present invention in an uncoupled position.

Circular openings 74–76, semi-circular pin locating surface 65, hitch pin opening 68 are all dimensioned slightly larger than the diameter of a hitch pin 80. As best shown in FIGS. 4 and 5, hitch pin 80 is adapted to extend in and to be always journaled within inboard bracket's circular opening 75 and intermediate bracket's circular opening 76 and hitch pin 80 can axially move to extend through and be journaled within outboard bracket's circular opening 74. More specifically, hitch pin 80 has a disconnect position such as shown in FIG. 5 wherein hitch pin 80 is journaled in inboard bracket's circular opening 75 and intermediate bracket's circular opening 76 and a connect position such as shown in FIG. 4 wherein hitch pin 80 extends through and is journaled within all brackets' circular openings 74–76. A spring mechanism is employed to position hitch pin 80 from its disconnect to its connect position and visa versa.

The spring mechanism includes a compression spring 82 overlying or receiving hitch pin 80 and positioned between intermediate bracket 72 and inboard bracket 71. Compression spring 82 is adapted to be compressed between wall surface 83 of inboard mounting bracket 71 and a snap ring 85 which is snapped into a groove 86 formed on hitch pin 80 at a position on hitch pin 80 whereat hitch pin 80 is between intermediate bracket 72 and inboard bracket 71. The position of snap ring 85 is such that snap ring 85 is adjacent wall surface 88 of intermediate bracket 72 which faces inboard bracket 71 when compression spring 82 is in its extended position. Again, spring 82 is in its extended position, hitch pin 80 extends through and is journaled in outboard bracket's circular opening 74, i.e. the connect position of the coupling as best shown in FIG. 4. In the disconnect position of the coupling as best shown in FIG. 5, snap ring 85 is spaced away from wall surface 88 and spring 82 is compressed.

The spring mechanism actuates the coupling from its connect to its disconnect position and vice versa by means of an L-shaped handle 90 affixed or welded to axial end 89 of hitch pin 80 adjacent inboard bracket 71. Handle 90 has a bight leg 92 welded to axial end 89 of hitch pin 80 and extending therefrom a latch leg 93 which terminates at a stop surface 95. Bight leg 92 is long enough in distance to enable the operator to grasp handle 90 in the space between hitch pin 80 and latch leg 93 so as to axially pull and rotate hitch pin 80 against the face of compression spring 82 which is compressed between snap ring 85 and inboard bracket wall surface 83. The length of latch leg 93 at least equals the distance compression spring 82 is compressed which in turn is at least equal to the distance between outboard bracket 70 and intermediate bracket 72. The operator axially pulls hitch pin 80 vis-a-vis handle 90 and rotates handle 90 so that stop surface 95 contacts the inboard wall facing surface 97 f inboard bracket 71. Latch leg 93 thus locks compression spring 82 into its compressed position as shown in FIG. 5 and the operator merely rotates handle 90 until bight leg 92 positions latch leg 93 to clear inboard bracket 71 and thus permit compression spring 82 to move hitch pin 80 into its connect position shown in FIG. 4.

OPERATION

Referring now to FIGS. 4, 5, 7 and 8, to mount snow plow 10 to vehicle 12, the operator pulls hitch pin 80 by handle 90 to the disconnect position shown in FIG. 5 and as discussed above. Pushframe 20 and pushbeam 21 are manually positioned into the relationships generally shown in FIGS. 5 and 7 and ear plates 47 and 50 are brought into proper registry with brackets 70–72 by moving one or both of the members. Typically snow plow 10 is fixed and vehicle 12 moved. To assure proper positioning, aligning surface 78 in intermediate bracket 72 laterally positions hitch ear plate 47 and retaining ear plate 50 into proper alignment so that retaining ear portion 52 is in between inboard bracket 70 and intermediate bracket 72 while hitch ear plate 47 will clear inboard wall facing surface 97 of inboard bracket 71. Next, gathering surface 64 will contact hitch pin 80 adjacent the inboard side of inboard bracket 71 and will ramp hitch pin 80 into semi-circular pin locating surface 65. In this position, hitch pin opening 68 is aligned with circular openings 74–76 in mounting brackets 70–72. The operator simply rotates handle 90 from its FIG. 5 and FIG. 7 position to the position shown in FIGS. 4 and 8 and spring 82 axially moves hitch pin 80 to its connect position as described above. No external force is required. The hitch pin simply snaps into place vis-a-vis the force of compression spring 82. In fact, moving vehicle 12 forward against stationary snow plow 10 until snow plow 10 and vehicle 12 move together insure that hitch pins 80 are in semi-circular pin locating surface 65. To disconnect, the operation is simply reversed. The hitch pin 80 is simply axially pulled back and handle 90 rotated so that latch leg 93 latches hitch pin 80.

This arrangement has been found to provide very easy hookup with vehicle 12 not achieved in prior art couplings. Importantly, spring 82 insures that hitch pin 80 remains journaled in all three brackets 70–72 and will not jiggle or work its way out of its locked position when the vehicle is driven with snow plow 10 attached. Somewhat less obvious is the fact that when connected, each strut 42 is pinned at two laterally spaced surfaces. That is, hitch pin opening 68 as well as semi-circular pin locating surface 65 transmit plow forces to vehicle 12 at two distinct points on hitch pin 80 thus rendering a secure connection especially when contrasted to the prior art quick connect couplings discussed above which only transmit plow forces at one hinge point per strut. This makes for less wear on the coupling and also makes the arrangement more resistant to any yawing tendency of the blade relative to the vehicle. Another advantage of the invention is that hitch pin opening 68 is providing complete circumferential engagement of hitch pin 80 which is not achieved in the prior art quick connect couplings discussed above where the pin is locked between two semi-circular members which are latched into a locking position. Thus inherently, the pin-hole connection of my invention has less slop or slack than that employed in the prior art while permitting pushframe 20 to be easily lifted and lowered in operation without any binding in the coupling.

Figure 10:
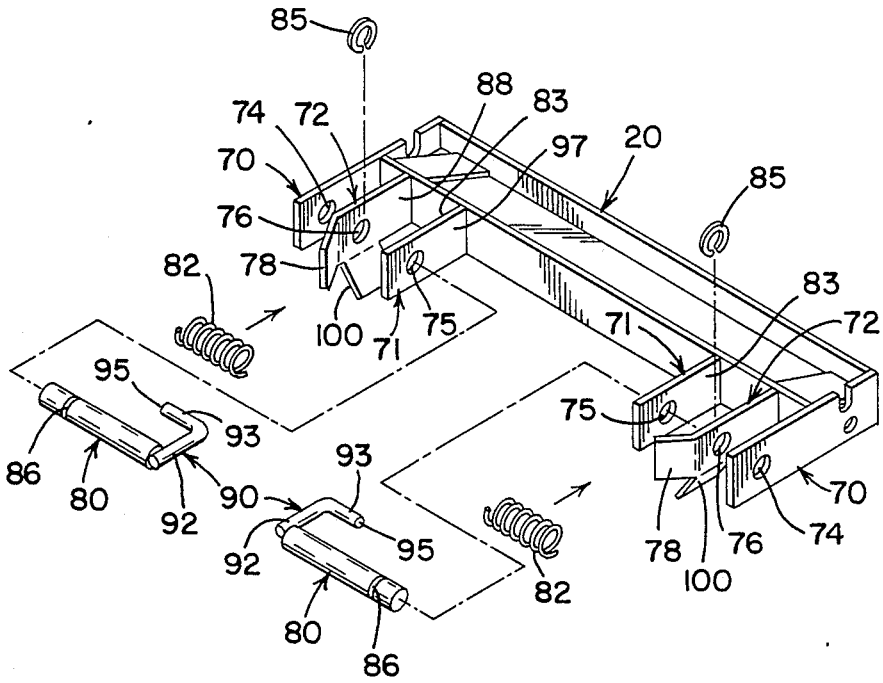
FIG. 10 is a perspective view of the pushbeam showing an improvement to that shown in FIGS. 1–9.

FIG. 10 illustrates an improvement in the pin means and is, in fact, the preferred arrangement. The pin means illustrated and disclosed in FIGS. 1–9 except for intermediate bracket 72 and the same reference numerals employed in describing the components of the invention in FIGS. 1–9 are used to describe the same components in FIG. 10 where applicable. As described above, intermediate bracket 72 has an aligning surface 78 used to assist in laterally positioning retaining ear plate 50 in between intermediate bracket 72 and outboard bracket 70. As shown in FIG. 10, intermediate bracket 72 also has a bottom vertical aligning tab or surface 100 which depends from the bottom edge of intermediate bracket 72 and is bent or canted towards inboard bracket 71 in much the same fashion as aligning surface 78 is bent or canted towards inboard bracket 71. Vertical aligning surface 100 further improves the gathering range of the connect-disconnect coupling when snow plow 10 is to be mounted to vehicle 12. In a typical mounting, chain 34 is attached to plow frame 20 and lift cylinder 37 is actuated to bring ear plates 47, 50 into position or registry with brackets 70–72 from underneath. To accommodate this type of mounting, relief surface 66 is provided on hitch ear plate 47. Importantly, vertical aligning surface 100 then contracts the top edge of retaining ear plate 50 while aligning surface 78 contacts the rearward edge of retaining ear plate 50 to position or gather ear plates 47, 50 into their proper relationship or into registry with brackets 70–72. At this point, relief surface 66 or gathering surface 64 on hitch ear plate 47 acts to precisely position ear plates 47, 50 so that semicircular surface 65 contacts hitch pin 80 on the inboard side of inboard bracket 71 as described above. This gathering range arrangement materially increases the ease of operation of the coupling and insures that hitch pin 80 will be properly actuated into the connected position of the coupling by the spring mechanism.

The invention has been described with reference to a preferred embodiment. Obviously, modifications and alterations will become apparent to those skilled in the art upon reading and understanding my invention. For example, the brackets and ears could be reversed so that the brackets are mounted to the pushframe and the ears are mounted to the pushbeam. More than two struts can be provided. While a kit is contemplated comprising the brackets and ears being supplied as loose pieces and welded to the pushframe and pushbeam, a bolt-on arrangement could be fabricated. While the coupling has been described with only one retaining plate, it can be easily understood that a second retaining plate could be used. It is my intention to include all such modifications insofar as they come within the scope of the present invention.

It is thus the essence of my invention to provide a quick connect-disconnect coupling for snow plows and like implements which use a gathering plate to assure coupling alignment and a retaining plate in combination with a spring biased pin arrangement to assure a true pin connection in a quick connect-disconnect coupling.

Having thus defined my invention, I claim:

1. A quick connect-disconnect coupling for mounting a pushframe attached to a plow to a pushbeam attached to a vehicle, said coupling comprising:

(a) said pushframe having a forward end mounted to a moldboard of said plow and a rearward end having a pair of laterally spaced positioning ear means for coupling and uncoupling said frame to said beam, each of said ear means including a hitch ear plate and laterally spaced therefrom a retaining ear plate, said hitch ear plate having a forward end affixed to said pushframe and a rearward end having a rearward edge surface defined by a gathering surface terminating in a generally centrally positioned, semi-circular, pin locating surface; said retaining plate having a forward end affixed to said pushframe and a rearward end with a generally circular hitch pin opening extending therethrough, said semi-circular locating surface aligned with said circular opening;

(b) said pushbeam having a pair of laterally spaced pin means for being coupled to and uncoupled from said ear means, each pin means including an inboard mounting bracket, an outboard mounting bracket and an intermediate bracket therebetween, each bracket having a generally circular opening extending therethrough with all bracket openings aligned with one another; a hitch pin; two position spring means associated with said hitch pin operable to position said hitch pin from an uncoupled position whereat said pin is journaled only in said inboard and intermediate brackets with one of its end generally flush with said intermediate bracket to a coupled position whereat said hitch pin extends through and is journaled in all said openings in said brackets;

(c) said ear means and said pin means cooperating with one another to accurately position said retaining plate between said outboard and said intermediate brackets when said semi-circular pin locating surface contacts said hinge pin on the side of said inboard bracket opposite to that side thereof facing said intermediate bracket when said spring means is in said uncoupled position and to permit said hitch pin to extend through said circular opening of said retaining ear plate when said spring means is in said coupled position so that said pushframe is connected in or from pin connector to said pushbeam.

2. The plow coupling of claim 1 wherein said spring means includes a compression spring receiving said hitch pin and positioned between said intermediate bracket and said inboard bracket; a snap type ring affixed to said hitch pin at a position thereon such that said spring is compressed between said snap ring and said inboard bracket, and handle means secured to the end of said hinge pin adjacent said inboard bracket for compressing and latching said spring when said spring means is in said uncoupled position and unlatching said spring to permit said spring to expand and axially move said hinge pin through said opening in said outboard bracket when said spring means is in its coupled position.

3. The plow coupling of claim 2 wherein said handle means includes an angle member having a bight leg and a latch leg depending therefrom, the free end of said bight leg affixed to the end of said hinge pin adjacent said inboard bracket, and the free end of said latch leg adapted to contact the face surface of aid inboard bracket opposite said intermediate when said spring is compressed whereby said handle means latches said spring in its uncoupled position.

4. The plow coupling of claim 3 wherein said inboard bracket is sized such that the distance from its opening to said pushbeam is greater than the length of said bight leg while the distance said inboard bracket's opening to the edge of said inboard bracket adjacent its opening is less than the length said bight leg and the length of said latch leg is at least equal to the distance between said intermediate bracket and said outboard bracket so that said latch leg maintains said hitch pin out of the space between said intermediate and outboard brackets when said spring is compressed in said uncoupled position while permitting said pin to rotate to a position whereat said latch leg passes bracket's edge surface permitting said spring to axially move said hinge pin into said outboard bracket's opening.

5. The plow coupling of claim 1 wherein said forward end of said pushframe includes a strut having more than two openings extending therethrough, said forward end of said hitch ear plate having more than two openings therein, connecting means for securing said forward end of said hitch ear plate to said strut through at least two openings in said hitch ear plate and said strut in registry therewith; said retainer having a plurality of hitch pin openings therein, and said openings in said retainer plate, said hitch ear plate and said strut in a predetermined relationship with one another such that the use of two different openings in said hitch ear plate to affix said hitch ear plate to said strut results in a different openings in said ear retainer plate receiving said hitch pin whereby said coupling compensates for variations in vehicle height.

6. The plow coupling of claim 1 wherein said intermediate bracket has a rearward end affixed to said pushbeam and a forward end with said circular pin openings spaced in between said forward and rearward ends, said intermediate bracket bent between said forward end and a position adjacent to said pin opening towards said inboard bracket to provide a positioning surface for directing said retainer ear into the space between said intermediate and said outboard brackets while permitting said gathering surface of said hitch ear to contact said hitch pin adjacent to said inboard brackets.

7. The plow coupling of claim 6 wherein said intermediate bracket has a bottom vertically extending aligning surface extending from the bottom edge of said intermediate bracket and bent towards said inboard bracket to position said retaining ear plate in between said intermediate and said outboard bracket when said ear means are brought into registry with said pin means from underneath said pushbeam.

8. In combination a pushframe attached to a plow, a pushbeam attached to a vehicle and a connector for coupling and uncoupling said pushframe and said pushbeam comprising:

positioning ear means attached to one of said push members for aligning said pushframe with said pushbeam and pin means attached to the other push member for pinning said pushbeam to said pushframe when said positioning means has properly aligned said push members;

said positioning means including a hitch ear plate and laterally paced therefrom a retaining ear plate, said retaining ear plate having a circular pin retention opening therethrough, said hitch ear plate having a gathering edge surface terminating in semi-circular pin locating surface;

said pin means including an inboard bracket, an outboard bracket and an intermediate bracket therebetween, each bracket having a generally circular opening extending therethrough with each bracket opening aligned with the other bracket openings; a hitch pin journaled in said inboard and intermediate brackets and two position spring means operable to position said hitch pin from (i) a first aligned position whereat said pin extends from the inboard side of said inboard bracket, through said inboard bracket's opening to and in said intermediate bracket's opening while said positioning means positions said retainer ear plate into the space between said outboard and said intermediate bracket and said hitch ear plate engages said hitch pin at said semicircular opening adjacent the inboard side of said inboard bracket, to (ii) a second coupled position whereat said hitch pin extends through said pin retention opening in said retaining ear plate and into said outboard bracket's opening whereby said pushframe is securely coupled to said pushbeam in a manner which permits free pivotal movement in a vertical plane.

9. The combination of claim 8 wherein said positioning means is secured to said pushframe and includes at least two laterally spaced pairs of hitch ear plates and ear retaining plates and said pin means includes at least two laterally spaced sets of brackets and with spring means associated with each set of brackets.

10. The combination of claim 9 wherein said retaining ear plate has a plurality of pin retention openings and said hitch ear plate has adjustment means for varying its attachment to said pushframe whereby said positioning means can be adjusted for different vehicle heights.

11. The combination of claim 8 wherein said ear plate, said brackets, said spring and said hitch pin are loose pieces in kit form adapted to be mounted to a standard type pushbeam and pushframe.

12. The combination of claim 9 wherein said intermediate bracket has a forward portion bent towards said inboard bracket and an aligning tab vertically extending from its bottom edge and bent towards said inboard bracket to assure said positioning ear means are brought into proper registry with said pin means.

* * * * *